United States Patent [19]

Ludwig

[11] Patent Number: 5,011,072

[45] Date of Patent: Apr. 30, 1991

[54] SPORT CARD STABILIZER

[75] Inventor: Henry F. Ludwig, Fullerton, Calif.

[73] Assignee: Morris Reisman, Villa Park, Calif.

[21] Appl. No.: 566,142

[22] Filed: Aug. 13, 1990

[51] Int. Cl.[5] ..... B65D 1/24

[52] U.S. Cl. ..... 229/120.23; 229/120.35; 200/45.18

[58] Field of Search ..... 229/120.23, 120.35; 206/45.18

[56] References Cited

U.S. PATENT DOCUMENTS

| | | | |
|---|---|---|---|
| 1,719,681 | 7/1929 | Wiebusch | 200/45.18 |
| 2,308,177 | 1/1943 | Jones | 229/120.23 |
| 2,517,767 | 8/1950 | Cody | 229/120.23 |
| 3,119,194 | 1/1964 | Ray | 206/45.18 |
| 4,400,161 | 8/1983 | Gealt | 206/45.18 |

*Primary Examiner*—Joseph M. Moy

*Attorney, Agent, or Firm*—Edgar W. Averill, Jr.

[57] ABSTRACT

A stabilizer for holding sport cards, or other cards, in a vertical to an angled position so that the user can easily view a group of cards by flipping through them. The stabilizer is preferably made from card stock which, in an unfolded position, forms an elongated, rectangular sheet. When the card is properly folded, it forms an angled card rest, and a tab in one portion of the card fits into a slot in the other portion of the card.

8 Claims, 1 Drawing Sheet

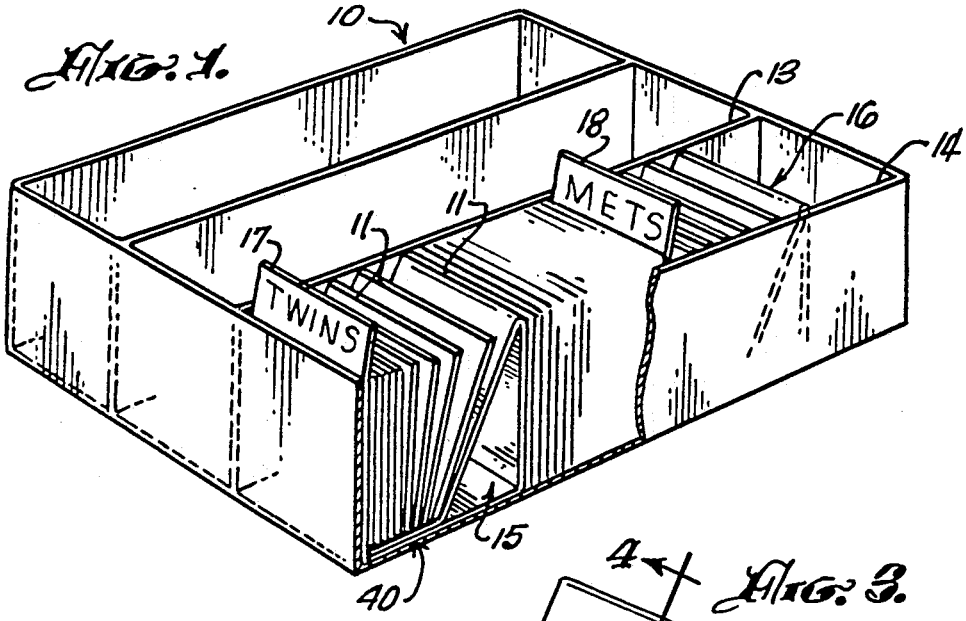
FIG. 1.
10
13
16
14
18
METS
11
17
11
TWINS
15
40
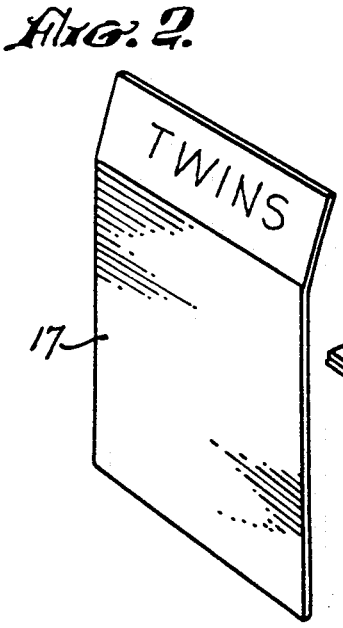
FIG. 2.
TWINS
17
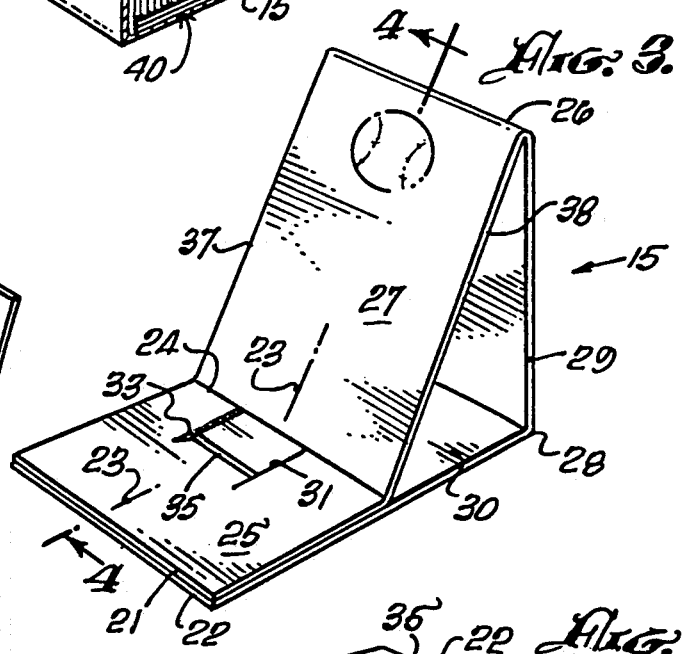
4
FIG. 3.
26
38
37
15
27
24
23
29
33
23
35
31
28
30
25
4
21
22
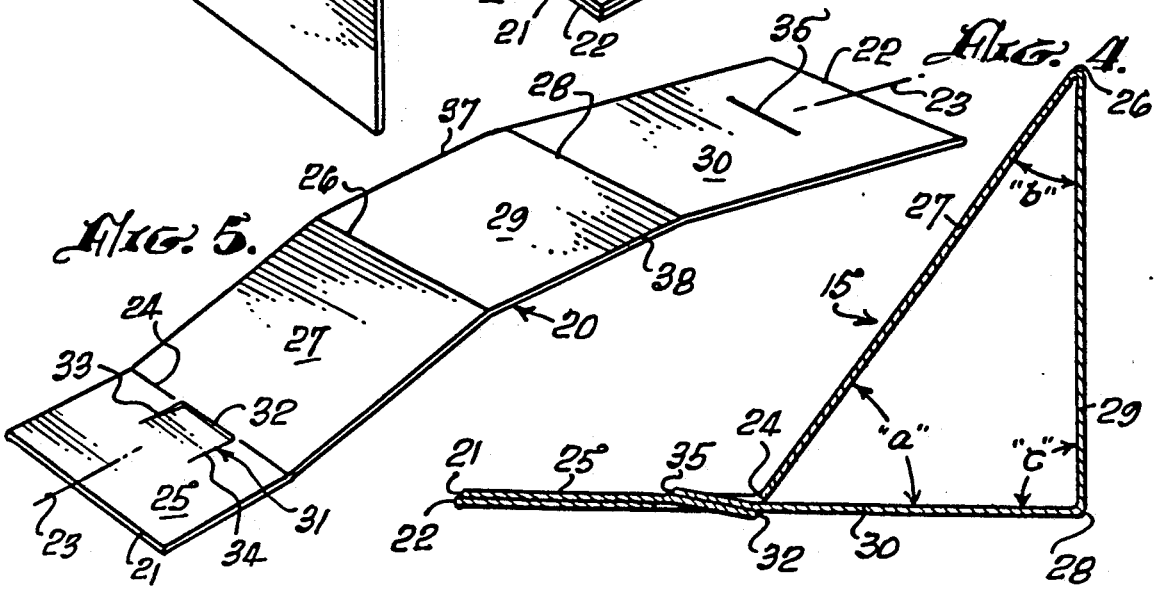
FIG. 4.
36
22
23
26
28
37
30
26
29
27
"b"
38
FIG. 5.
24
20
15
27
33
32
29
24
"a"
"c"
21
25
35
25
31
22
32
30
28
23
21
34

SPORT CARD STABILIZER

BACKGROUND OF THE INVENTION

The field of the invention is filing accessories, and the invention relates more particularly to devices for assisting in the filing of index cards or other types of cards.

The hobby of collecting baseball cards is presently very popular, and the baseball cards are typically held in a box such as a shoe box, and such boxes are often partitioned lengthwise, so that two or more rows of cards can be held adjacent one another. With baseball cards, it is important to be able to flip through the cards, and when they are tightly packed in a box, this is difficult to do. When they are loosely packed in a box, they tend to slump down, and some of the cards can slide to the bottom of the box. Various card holders and organizers are known, and patents showing card organizers include U.S. Pat. Nos. 386,952; 769,855; 1,071,375; 1,739,545; 2,649,093 and 3,198,339. Most of these devices are designed to work with a particular style of box or are formed of wood or metal and not easily foldable for mailing or display.

SUMMARY OF THE INVENTION

It is an object of the present invention to provide a stabilizer for holding and assisting the organizing of baseball cards or other index cards, which device may be readily folded into a flat configuration for storage or mailing.

The present invention is for a stabilizer for holding sport cards or other cards in a vertical to an angled position so that the user can easily view a group of cards. The stabilizer is collapsible for compact storage or mailing. The stabilizer comprises an elongated, rectangular, unitary sheet having a longitudinal axis, a first end, a second end and two longitudinal edges and having three folds perpendicular to the longitudinal axis extending between the longitudinal edges and two cuts. The unitary sheet includes a first fold in an upward direction separated from the first end and forming a first panel between the first end and the first fold. A second fold in a downwardly direction is separated from the first fold and forms a second panel between the first and second folds. A third fold in a downward direction is separated from the second fold and the second end and forms a third panel between the second fold and the third fold and a fourth panel between the third fold and the second end. A first cut generally in the shape of a "U" has the base of the "U" lying parallel to the folds and the arms of the "U" pointing away from the second and third folds. A second and third cut in the form of a straight line is parallel to the folds, and one of the cuts is in the first panel and the other of the cuts is in the fourth panel. Preferably, the "U" shaped cut is in the first panel. The panel sizes are formed so that when the device is folded into its stabilizer shape a right triangle is formed with the third and fourth panels positioned at a right angle with respect to one another and the second and third panels forming an angle of between 20° and 50° and, preferably, about 35° with respect to one another. This forms an angle between the second and fourth sides of between 70° and 40° and, preferably, about 55°. The first panel overlies part of the fourth panel so when the cards are placed on the stabilizer, they help to hold the device in its assembled position and also help prevent the stabilizer from moving.

BRIEF DESCRIPTION OF THE DRAWINGS

FIG. 1 is a perspective view of a baseball card box including the stabilizer for holding sport cards of the present invention.

FIG. 2 is a perspective view of a title card used as part of the baseball card box of FIG. 1.

FIG. 3 is a perspective view of the stabilizer for holding sport cards of the present invention.

FIG. 4 is a cross-sectional view taken along line 4—4 of FIG. 3.

FIG. 5 is a perspective view of the stabilizer for holding sport cards of FIG. 3 in an unfolded configuration.

DESCRIPTION OF THE PREFERRED EMBODIMENTS

A box for holding baseball cards is shown in perspective view in FIG. 1 and indicated generally by reference character 10. A plurality of baseball cards 11 is shown in the first row 12 of box 10 between sides 13 and 14. Two card stabilizers 15 and 16 are shown in FIG. 1, and it can be seen that the cards in front of stabilizer 15 can be easily viewed by flipping through the same. Two dividers 17 and 18 include the name of teams and extend upwardly above the baseball cards, the upper portion of which are creased to fold back for facilitating the covering of the box.

The stabilizer 15 is shown in perspective view in FIG. 3 and in an unfolded view in FIG. 5. As viewed in FIG. 5, the stabilizer unfolds to an elongated, rectangular, unitary sheet 20 which has a first end 21 and a second end 22. There are three folds which are at right angles to the longitudinal axis 23 of sheet 20. The first fold 24 is in an upward direction and forms a first panel 25 between the first fold 24 and the first end 21. A second fold 26 is in a downward direction and forms a second panel 27 between first fold 24 and second fold 26. A third fold 28 is also in a downward direction and forms a third panel 29 between the second fold 26 and the third fold 28. The third fold 28 also forms a fourth panel 30 between the third fold 28 and the second end 22. A first cut 31 is a generally "U" shaped cut having a base 32, a first arm 33 and a second arm 34. The base 32 lies along the first fold 24. A second cut 35 is near the center of the fourth panel 30 and is parallel to the folds of sheet 20. When the stabilizer is assembled from its position in FIG. 5 to its position in FIG. 4, the tab 36 is inserted through the second cut 35, and the assembled device is shown in side view in FIG. 4.

The distance between longitudinal edges 37 and 38 is just slightly less than the width of row 12 so that the stabilizer is securely held against sideways movement by the row. The cards 11 are held against panel 27 at an angle of between 40° and 70° and, preferably, about 55°. This angle is indicated by reference character "a." The angle "c" between the third and fourth panels is preferably about a right angle meaning that angle "b" is between 20° and 50° and, preferably, about 35°. As shown best in FIG. 4, the first panel 25 rests over a portion of the fourth panel 30 so that cards 11 will help hold the stabilizer in its assembled configuration as shown best in FIG. 1 at reference character 40.

As is readily evident from FIG. 5, the stabilizer of the present invention can readily be stored or mailed in a flat configuration and assembled for use by the purchaser. As shown by the position of stabilizer 16 in FIG. 1, the card also functions as a stop and permits the user to hold the cards in a vertical or slightly angled position which greatly reduces the possibility that a card could slide down to the bottom of box 10.

While the "U" shaped cut 31 is shown in the first panel and the straight cut is shown in the fourth panel, it is possible that the position of these cuts be reversed. That is, the "U" shaped cut could be formed in the fourth panel and the straight cut formed along the first fold. The positioning shown in the drawings is, however, preferred. The device should be formed from card stock so that it will have sufficient stiffness to hold the baseball or other cards.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A stabilizer for holding sport cards or other cards in a vertical to an angled position so that the user can easily view a group of cards, said stabilizer being collapsible for compact storage, said stabilizer comprising:

an elongated, rectangular, unitary sheet having a longitudinal axis, a first end, a second end and two longitudinal edges and having three folds perpendicular to said longitudinal axis extending between the longitudinal edges and two cuts, said unitary sheet including:

a first fold in an upward direction separated from said first end forming a first panel between the first end and the first fold;

a second fold in a downward direction separated from said first fold forming a second panel between said first fold and said second fold;

a third fold in a downward direction separated from said second fold and said second end forming a third panel between said second fold and said third fold and a fourth panel between said third fold and the second end of the elongated rectangular unitary sheet;

a first cut formed in one of said first and fourth panels, said first cut being in a generally "U" shape with the base of the "U" lying parallel to said folds and the arms of the "U" pointing away from the second and third folds and forming a tab from the panel; and a second cut being in a straight line parallel to said folds, one of the cuts being in the first panel and the other of the cuts being in the fourth panel and said unitary sheet being folded so that said first panel is entirely supported on said fourth panel.

2. The stabilizer for holding sport cards of claim 1 wherein the "U" shaped cut is in the first panel.

3. The stabilizer for holding sport cards of claim 2 wherein the base of the "U" shaped cut lies along the first fold.

4. The stabilizer for holding sport cards of claim 3 wherein the elongated, rectangular, unitary sheet folds into a shape wherein the fourth panel is at the base and is in a horizontal position, the third panel is at about vertical, and the second panel forms the hypotenuse of a right triangle with the third panel as one side and a part of the fourth panel as the third side, and the first panel overlies the remaining portion of the fourth panel.

5. The stabilizer for holding sport cards of claim 4 wherein the angle between the second and third panels is between 20° and 50°.

6. The stabilizer for holding sport cards of claim 5 wherein said angle is about 35°.

7. A stabilizer for holding sport cards or other cards in a vertical to an angled position so that the user can easily view a group of cards, said stabilizer being collapsible for compact storage, said stabilizer comprising:

an elongated, rectangular, unitary sheet having a longitudinal axis, a first end, a second end and two longitudinal edges and having three folds perpendicular to said longitudinal axis extending between the longitudinal edges and two cuts, said unitary sheet including:

a first fold in an upward direction separated from said first end forming a first panel between the first end and the first fold;

a generally "U" shaped cut formed in said first panel wherein the base of the "U" shaped cut lying along the first fold and the arms of the "U" shaped cut extending toward said first end;

a second fold in a downward direction separated from said first fold forming a second panel between said first fold and said second fold;

a third fold in a downward direction separated from said second fold and said second end forming a third panel between said second fold and said third fold and a fourth panel between said third fold and the second end of the elongated rectangular unitary sheet;

a second cut being in a straight line parallel to said folds, said second cut being in said fourth panel.

8. The stabilizer for holding sport cards of claim 7 which, when it is in a folded configuration, has its third and fourth panels positioned at about a right angle and the first and second ends of said elongated rectangular unitary sheet are adjacent one another.

* * * * *